US006708523B2

(12) United States Patent
Lochner et al.

(10) Patent No.: US 6,708,523 B2
(45) Date of Patent: Mar. 23, 2004

(54) PROCESS AND APPARATUS FOR PRODUCING HIGH-PURITY NITROGEN BY LOW-TEMPERATURE FRACTIONATION OF AIR

(75) Inventors: Stefan Lochner, Grafing (DE); Ralph Spöri, Geretsreid (DE); Michael Lauter, Augsburg (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/264,261

(22) Filed: Oct. 4, 2002

(65) Prior Publication Data

US 2003/0079499 A1 May 1, 2003

(30) Foreign Application Priority Data

Oct. 4, 2001 (DE) ..... 101 48 820
Oct. 4, 2001 (DE) ..... 101 48 818

(51) Int. Cl.[7] ..... F25J 3/04
(52) U.S. Cl. ..... 62/643; 62/649; 62/652; 62/912
(58) Field of Search ..... 62/643, 646, 652, 62/648, 649, 912

(56) References Cited

U.S. PATENT DOCUMENTS 4,717,410 A 1/1988 Grenier
5,034,043 A * 7/1991 Rottmann ..... 62/652
5,137,559 A 8/1992 Agrawal
5,887,447 A * 3/1999 Higginbotham ..... 62/643
5,964,104 A 10/1999 Rottmann
6,050,106 A * 4/2000 Yamamoto et al. ..... 62/643
6,196,022 B1 * 3/2001 Horst et al. ..... 62/643
6,196,023 B1 3/2001 Corduan et al.
6,308,533 B1 * 10/2001 Nohlen ..... 62/643

FOREIGN PATENT DOCUMENTS

EP 0539268 A1 4/1993
EP 0 948 730 10/1999
EP 0 955 509 11/1999
EP 0955509 A1 11/1999

* cited by examiner

*Primary Examiner*—William C. Doerrler
(74) *Attorney, Agent, or Firm*—Millen, White, Zelano & Branigan, P.C.

(57) ABSTRACT

The invention relates to a process and apparatus for producing nitrogen by low-temperature fractionation of air in a rectification system which has a high-pressure column (4) and a low-pressure column (5). Feed air (1, 3) is introduced into the high-pressure column (4). An oxygen-containing liquid fraction (11) is removed from the high-pressure column (4) and fed into the low-pressure column (5). Gaseous nitrogen (18) is extracted from the low-pressure column (5) above a mass transfer section (25), which has at least one theoretical or practical plate, and is at least partially condensed in a top condenser (17) by indirect heat exchange with a refrigerant (13). High-purity nitrogen is removed from the low-pressure column below the mass transfer section (25), and is obtained as a nitrogen product (26, 27, 30). The process and apparatus have a refrigeration-supply system, in which a refrigeration fluid (31) flows. At least part of the refrigeration fluid from the refrigeration-supply system is introduced into the low-pressure column (5) above the mass transfer section (25).

21 Claims, 3 Drawing Sheets

PROCESS AND APPARATUS FOR PRODUCING HIGH-PURITY NITROGEN BY LOW-TEMPERATURE FRACTIONATION OF AIR

The invention relates to a process for producing nitrogen by low-temperature fractionation of air in a rectification system which has a high-pressure column and a low-pressure column, in which process charge air is introduced into the pressure column, an oxygen-containing liquid fraction is removed from the high-pressure column and fed into the low-pressure column, gaseous nitrogen is extracted from the low-pressure column above a mass transfer section which has at least one theoretical or practical plate, and is at least partially condensed in a top condenser by indirect heat exchange with a refrigerant, and high-purity nitrogen is removed from the low-pressure column below the mass transfer section and is obtained as nitrogen product.

Processes of this type and corresponding apparatus are known from EP 948 730 B1 and EP 955 509 A1. In these cases, nitrogen can be obtained under elevated pressure in the low-pressure column. If blocking plates ("mass transfer section which has at least one theoretical or practical plate") are built into the upper region of the low-pressure column, the nitrogen product can be of particularly high purity, and in particular can have a very low level of highly volatile impurities.

An object of the invention is to provide a process of the type described above and a corresponding apparatus which are particularly economically advantageous.

Upon further study of the specification and appended claims, further objects and advantages of this invention will become apparent to those skilled in the art.

These objects are achieved by a process which has refrigeration-supply system, in which a refrigeration fluid flows and at least part of the refrigeration fluid from the refrigeration-supply system is introduced into the low-pressure column above the mass transfer section. As an alternative, or in addition, within the context of the invention, it is also possible for the refrigeration fluid from the refrigeration-supply system to be introduced into the upper region of the high-pressure column.

In the invention, the refrigeration fluid may be formed by a readily available medium which is introduced into the low-pressure column and is in this way involved in the mass transfer in the low-pressure column, without the purity of the high-purity nitrogen product being impaired and without the operating pressure of the low-pressure column having to be matched to the requirements of the refrigeration-supply system. For example, if the refrigeration fluid is introduced into the low-pressure column the nitrogen content of the refrigeration fluid can be, e.g., at least 95 vol %, preferably at least 99 vol %. (An example of a suitable refrigeration fluid is nitrogen which still contains highly volatile impurities.) By contrast, in the refrigeration-supply system of the known processes, a residual fraction, for example from the evaporation space of the top condenser, is extracted, expanded in a work-performing manner to approximately atmospheric pressure and removed from the process. In this case, the minimum operating pressure of the top condenser and therefore that of the low-pressure column is determined solely by the refrigeration-supply system. This drawback is avoided in the invention without the product's purity being reduced.

In the invention, the refrigeration fluid is preferably fed in at the top of the low-pressure column.

In a first variant of the invention, the refrigeration fluid is removed from the high-pressure column, expanded in a work-performing manner in the refrigeration-supply system and introduced into the low-pressure column.

The work-performing expansion of a fluid, in particular a gas, from high-pressure-column pressure to low-pressure-column pressure allows particularly expedient generation of process refrigeration. In this way, the insulation and exchange losses can be compensated for and if appropriate small quantities of product can be liquefied. Upstream of its work-performing expansion, the refrigeration fluid is preferably heated in indirect heat exchange against process streams which are to be cooled.

The mass transfer section is formed by one or more rectification plates (known as barrier plates)—for this purpose, the information is given in "practical" plate number—or by a short packing section ("theoretical" plate number). The number of barrier plates or theoretical plates is, for example, 1 to 10, preferable 2 to 3. As a result of nitrogen product being extracted below these barrier plates, the nitrogen product has a very low level of the highly volatile impurities which remain in the top of the low-pressure column and, from there, are extracted with a less pure nitrogen stream.

The refrigeration fluid generally contains constituents which are more volatile than nitrogen. However, on account of the feed taking place above the mass transfer section described, these constituents do not pass into the nitrogen product which is extracted further down.

It is expedient if the refrigeration fluid is removed from the upper region of the high-pressure column. It is formed, by way of example, by a nitrogen-rich gas fraction from the high-pressure column, in particular by the top gas of this column.

According to a second variant of the invention, the refrigeration fluid is formed by a cryogenic liquid which has been produced outside the rectification system.

As a result of external fluid being fed in as refrigeration source (liquid assist), the process has a particularly high flexibility. By the way of example, machines for producing refrigeration, such as for example expansion turbines, can be completely or partially dispensed with. The cryogenic liquid may be formed, for example, by liquid nitrogen which originates from another air fractionation installation; alternatively, any other mixture of air components can be used. The external liquid may either be supplied via a pipeline or be removed from a storage vessel. It is fed in at that point which corresponds to the composition of the external liquid. This may be the upper region of the high-pressure column or low-pressure column.

The cryogenic liquid may be partially or completely introduced into the low-pressure column, preferably at the top of this column. As an alternative or in addition, the cryogenic liquid may be at least partially introduced into the upper region of the high-pressure column.

Refrigerant for the top condenser is preferably removed from the lower region of the low-pressure column, and all the oxygen-enriched product of the pressure column is fed into the low-pressure column. In the present context, the term "oxygen-enriched" is understood as meaning any fraction whose oxygen content is greater than that of air.

The nitrogen product may be extracted in gas form from the low-pressure column. Alternatively, it is removed in liquid form from the low-pressure column and evaporated in indirect heat exchange with refrigeration fluid which has been expanded in a work-performing manner. A combination of these two process steps is also possible.

In addition, the invention relates to an apparatus for producing nitrogen by low-temperature fractionation of air in a rectification system comprising:

a high pressure column (4) and a low-pressure column (5);

a feed line (1, 3) for introducing air into the high-pressure column (4);

a line (11) for introducing an oxygen-containing liquid fraction from the high-pressure column (4) into the low-pressure column (5);

a top condenser (17), the liquefaction side of which is connected to a region of the low-pressure column (5) above a mass transfer section (25), the mass transfer section having at least one theoretical or practical plate;

a nitrogen product line (26, 27, 30) for removing high-purity nitrogen, which is connected to the low-pressure column (5) below the mass transfer section (25); and a refrigeration-supply system, which has a refrigeration-fluid line (31, 32, 34; 38) connected to the low-pressure column (5) above the mass transfer section (25).

In accordance with a further aspect of the apparatus, the refrigeration-supply system has an expansion machine (33), the inlet of which is connected (11, 32) to the high-pressure column (4) and the outlet of which is connected (34) to the refrigeration-fluid line (31, 32, 34; 38).

According to a further aspect of the apparatus, the refrigeration-fluid line is a liquid line (38) for feeding into the refrigeration-supply system a cryogenic liquid produced outside the rectification system.

The invention and further details of the invention are explained in more detail; below with reference to the two exemplary embodiments—one for each of the two variants of the invention—illustrated in the drawing.

BRIEF DESCRIPTION OF THE DRAWINGS

Various features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
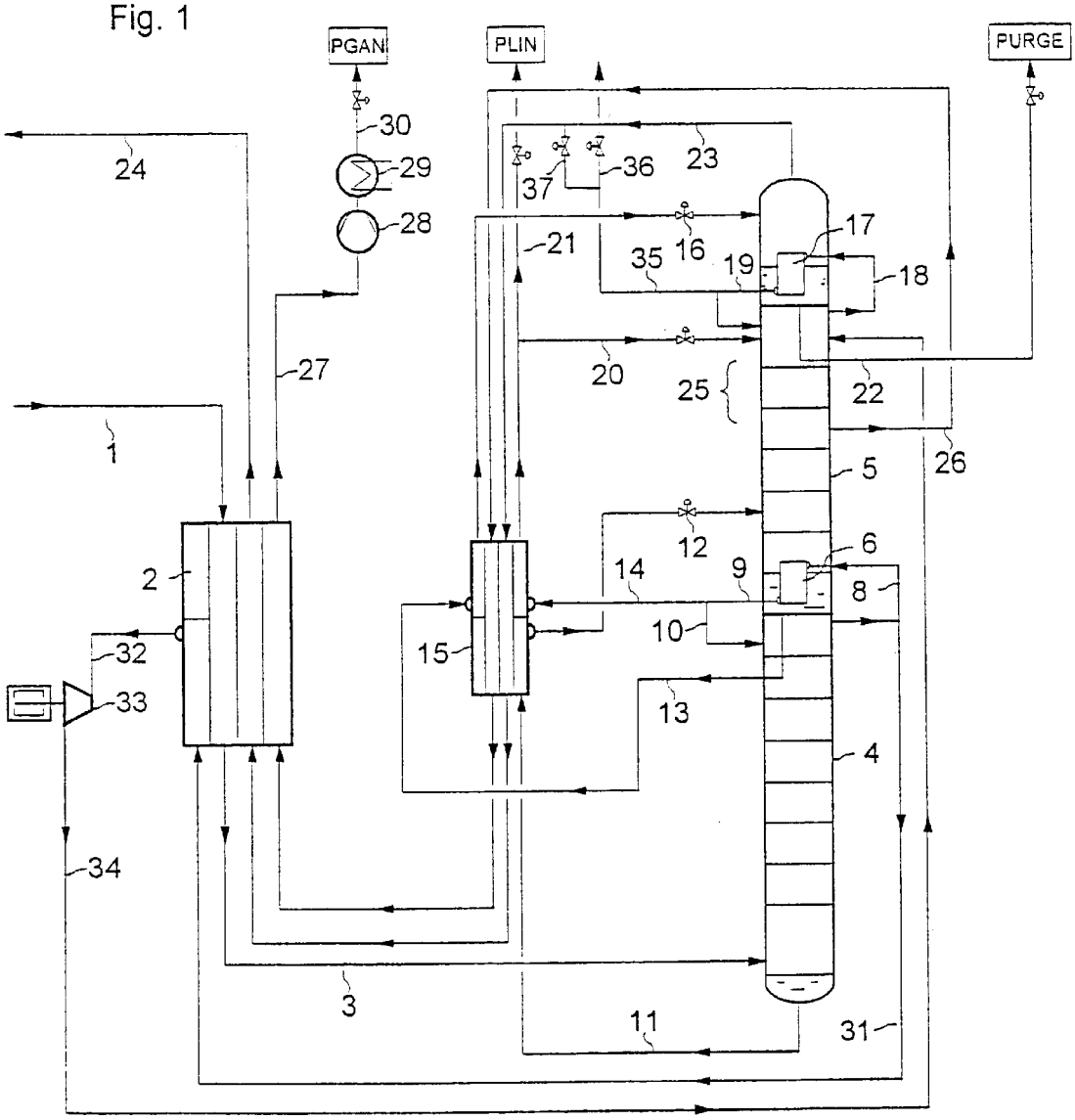
FIG. 1 illustrates an embodiment in which the refrigeration fluid is removed from the high-pressure column.

In the exemplary embodiment shown in FIG. 1, compressed and cleaned air 1 is cooled in a main heat exchanger 2 and fed (3) to a high-pressure column 4 at a pressure of 9 to 13 bar. The rectification system also has a low-pressure column 5, which is operated at a pressure of 2 to 5 bar and is in heat exchanging communication with the high-pressure column via a common condenser-evaporator (main condenser) 6. A part 8 of the nitrogen which has been removed at the top of the high-pressure column is liquefied in the main condenser 6 and is partially added, via the lines 9 and 10, to the high-pressure column as reflux. Another stream 14 of the liquid 9 from the main condenser 6 is supercooled (15), and a first part 20 of this stream is fed to the top of the low-pressure column 5 as reflux. A second part 21 of the supercooled nitrogen is removed as liquid product (PLIN). After being supercooled (15), the bottom liquid 11 from the high-pressure column is throttled (12) into the low-pressure column 5 as oxygen-containing liquid-fraction.

The bottom liquid 13 of the low-pressure column 5 is likewise supercooled (15) and expanded (16) and is then introduced into the evaporation space of the top condenser 17 of the low-pressure column 5. Gaseous nitrogen 18 from the top of the low-pressure column 5 condenses in the liquefaction space of this condenser; the condensate 19 is fed back into the low-pressure column, where it is used as additional reflux. A purge liquid (PURGE) is extracted continuously or intermittently from the lower region of the evaporation space of the top condenser 17 via line 22. The vapor 23 which is produced in the top condenser 17 is warmed to approximately ambient temperature in the heat exchangers 15 and 2 and is discarded via line 24 and/or used as regeneration gas for a cleaning apparatus (for example, a molecular sieve station) which is not shown. Uncondensed gas, which in particular contains relatively highly volatile components, is extracted via line 35. It is blown off (36) and/or admixed (37) with the vapor 23.

Below the top of the low-pressure column 5 there is a mass transfer section 25 which, in the example, is formed by three practical plates (barrier plates). Below this, gaseous nitrogen is removed as high-purity product via line 26 and is warmed to approximately ambient temperature in the heat exchangers 15 and 2. In the exemplary embodiment, the warm nitrogen product 27 is compressed further in a nitrogen compressor 28 with aftercooler 29 and is finally extracted via line 30 and end product (PGAN). The nitrogen end product contains, e.g., less than 100 ppb, preferably less than 10 ppb, of more volatile impurities (such as hydrogen, helium, neon).

Via line 31, a part of the gaseous top nitrogen is extracted from the high-pressure column 4 as refrigeration fluid, is warmed to an intermediate temperature in the main heat exchanger 2 and is fed to an expansion machine 33, which is designed, for example, as a generator turbine, via line 32. The refrigeration fluid 34 which has been expanded in a work-performing manner to approximately the low-pressure-column pressure is fed to the top if the low-pressure column, i.e., is fed in above the barrier plates 25. These process steps and/or the apparatus parts used for them form a "refrigeration-supply system" in accordance with the first variant of the invention.

As an alternative or in addition, according to the first variant of the invention, nitrogen as refrigeration fluid can be compressed to above high-pressure-column pressure in the "refrigeration-supply system", and can then be expanded in a work-performing manner and fed into the high-pressure column (preferably at the top) (not shown in the drawing).

Figure 2:
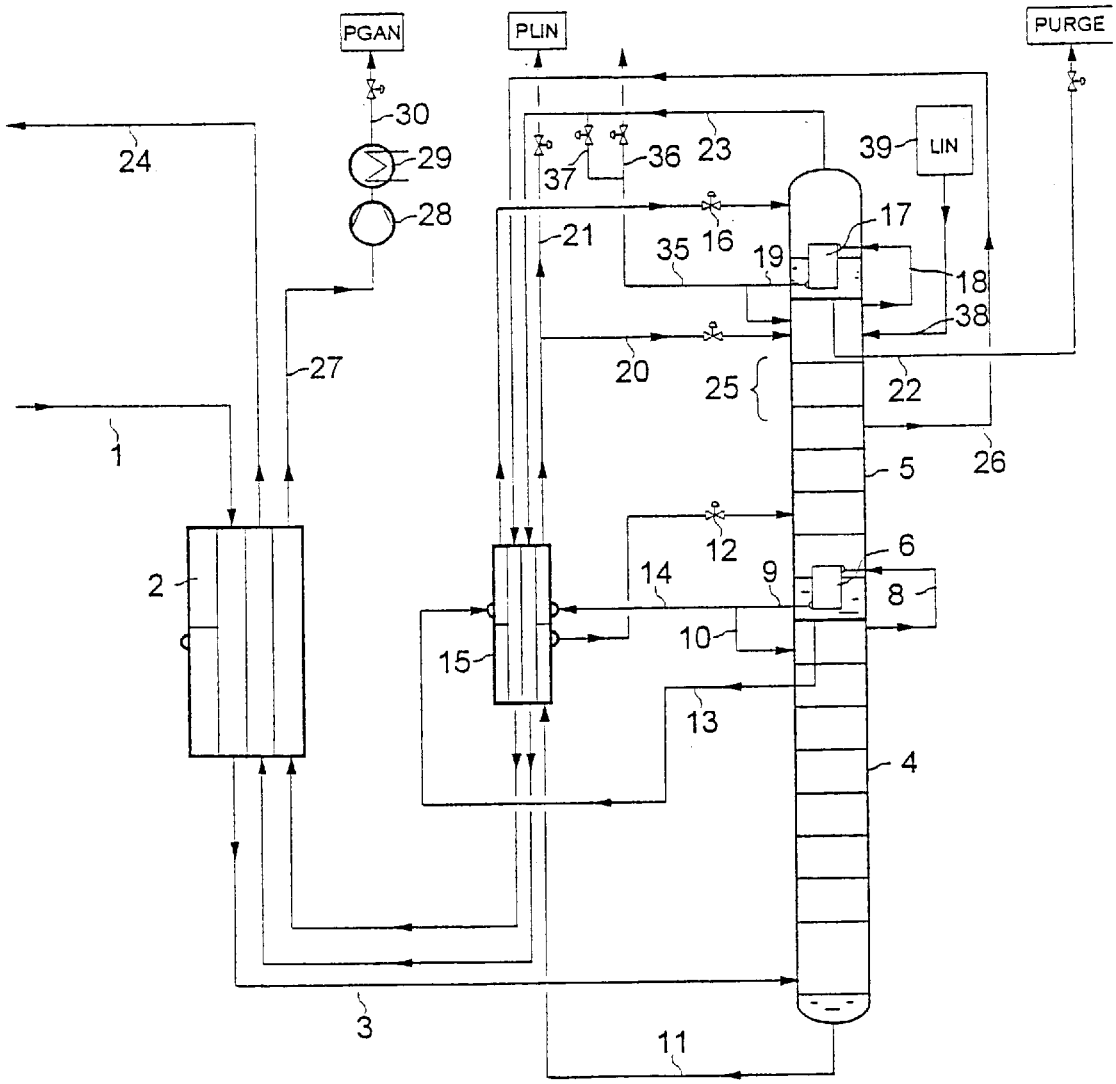
FIG. 2 illustrates an embodiment in which the refrigeration fluid is produced outside the refrigeration system.

In the event of the turbine 33 failing, the installation can be operated in emergency mode by a cryogenic liquid (38) from outside the rectification system being fed into one of the columns of the rectification system ("liquid assist"), as explained in the embodiment of FIG. 2. The cryogenic liquid does not necessarily have to have been produced outside the rectification system; rather, liquid (for example, liquid nitrogen) which is produced during normal operation of the installation and stored in a storage tank can also be used for emergency operation.

The exemplary embodiment shown in FIG. 1 may be modified in such a way that a gaseous and/or liquid oxygen product is produced in the low-pressure column. For this purpose, only part of the bottom liquid 11 from the high-pressure column is throttled, after supercooling 15, into the low-pressure column 5 as oxygen-containing liquid fraction; another part is branched off upstream of the valve 12 and passed into the evaporation space of the top condenser 17.

The feeding 16 of bottom liquid from the low-pressure column into this evaporation space is eliminated completely or partially. The oxygen product is extracted in gas and/or liquid from the bottom region of the low-pressure column 5.

In the exemplary embodiment shown in FIG. 2, compressed and cleaned air 1 is cooled in a main heat exchanger 2 and is fed (3) to a high-pressure column 4 at a pressure of 9 to 10 bar. In addition, the rectification system has a low-pressure column 5 which is operated at a pressure of 2 to 3 bar and is in heat-exchanging communication with the high-pressure column via a common condenser-evaporator (main condenser) 6. The nitrogen 8 which is removed at the top of the high-pressure column is liquefied in the main condenser 6 and is partially added to the high-pressure column as reflux via the lines 9 and 10. Another part 14 of the liquid 9 from the main condenser 6 is supercooled (15), and a first part 20 thereof is fed as reflux to the top of the low-pressure column 5. A second part 21 of the supercooled nitrogen is extracted as liquid product PLIN. After supercooling 15, bottom liquid 11 from the high-pressure column is throttled (12) into the low-pressure column 5 as oxygen-containing liquid fraction.

The bottom liquid 13 from the low-pressure column 5 is likewise supercooled (15) and expanded (16) and is then fed into the evaporation space of the top condenser 17 of the low-pressure column 5. Gaseous nitrogen 18 from the top of the low-pressure column 5 condenses into the liquefaction space of this condenser; the condensate 19 is fed back into the low-pressure column, where it is used as additional reflux. A purge liquid (PURGE) is extracted continuously or intermittently from the lower region of the evaporation space of the top condenser 17 via line 22. The vapor 23 which is produced in the top of condenser 17 is warmed to approximately ambient temperature in the heat exchangers 15 and 2 and is discarded via line 24 and/or used as regeneration gas for a cleaning device (for example, a molecular sieve station) which is not shown. Uncondensed gas, which in particular contains relatively highly volatile components is extracted via a line 35. It is blown off (36) and/or admixed (37) with the vapor 23.

Below the top of the low-pressure column 5 there is a mass transfer section 25, which in the example is formed by three practical plates (barrier plates). Below this, gaseous nitrogen is removed as high-purity product via line 26 and is heated to approximately ambient temperature in the heat exchangers 15 and 3. In the exemplary embodiment, the warm nitrogen product 27 is compressed further in a nitrogen compressor 28 with aftercooler 29 and is finally extracted via line 30 as end product (PGAN). The nitrogen end product contains, e.g., less than 100 ppb, preferably less than 10 ppb, of more volatile impurities (such as hydrogen, helium, neon).

Liquid nitrogen which has not been produced in one of the columns 4, 5 of the rectification system is fed to the top of the low-pressure column—i.e., above the barrier plates 25—via line 38. In the example, this cryogenic liquid is removed from a storage tank 39 which is filed from an external source, for example, by means of tankers. These process steps and/or the apparatus parts used to carry them out form a "refrigeration-supply system" in accordance with the second variant of the invention.

As an alternative, or in addition, in the "refrigeration-supply system" according to the second variant of the invention, liquid nitrogen from the storage tank 39 can be fed as refrigeration fluid into the high-pressure column (preferably at the top). See FIG. 3.

The exemplary embodiment shown in FIG. 2 may be modified in such a way that a gaseous and/or liquid oxygen product is produced in the low-pressure column. For this purpose, only a part of the bottom liquid 11 of the high-pressure column is throttled, after supercooling 15, into the low-pressure column 5 as oxygen-containing liquid fraction; another part is branched off upstream of the valve 12 and passed into the evaporation space of the top condenser 17. The feeding 16 of the bottom liquid from the low-pressure column into this evaporation space is dispensed with completely or partially. The oxygen product is extracted from the bottom region of the low-pressure column 5 in gas and/or liquid form.

Figure 3:
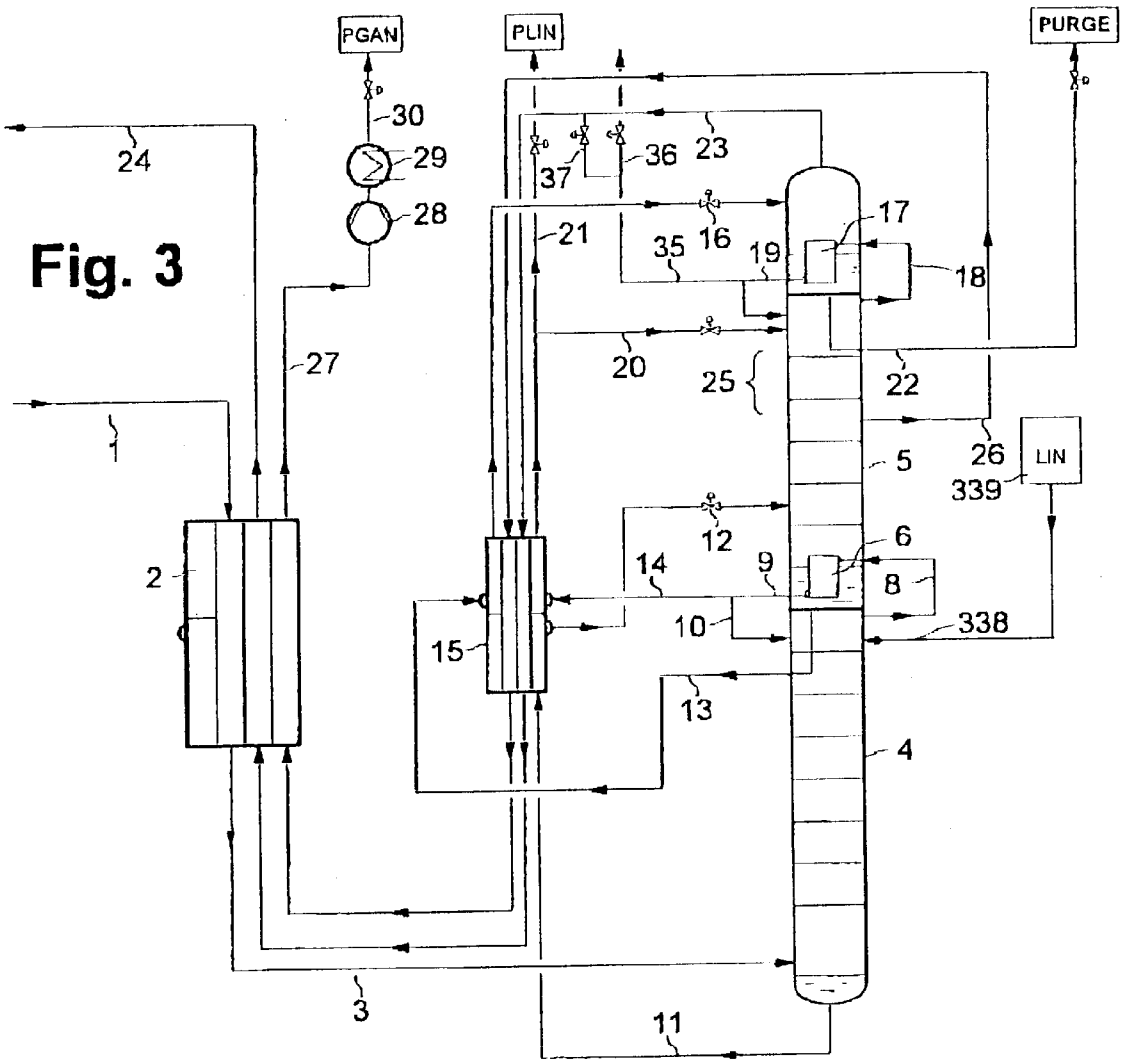
FIG. 3 illustrates an embodiment similar to that of FIG. 2 wherein the refrigeration fluid is introduced into the top of the high-pressure column.

In the embodiment of FIG. 3, the refrigeration fluid is introduced into the upper region of the high-pressure column from storage tank 339 via line 338. The remainder of the system is similar to the embodiment illustrated in FIG. 2.

The entire disclosures of all applications, patents and publications, cited herein and of corresponding German application No. 101 48 818.1, filed Oct. 4, 2001 and German application 101 48 820.3, filed Oct. 4, 2001, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for producing high-purity nitrogen by low-temperature fractionation of air in a rectification system which comprises a high-pressure column (4) and a low-pressure column (5), said process comprising:

introducing feed air (1, 3) into the high-pressure column (4), removing an oxygen-containing liquid fraction (11) from the high-pressure column (4) and feeding at least a portion of said oxygen-containing liquid fraction into the low-pressure column (5), extracting gaseous nitrogen (18) from the low-pressure column (5) above a mass transfer section (25) which has at least one theoretical or practical plate, and at least partially condensing said gaseous nitrogen in a top condenser (17) by indirect heat exchange with a refrigerant (13), and removing high-purity nitrogen (26, 27, 30) from the low-pressure column (5) below the mass transfer section (25), wherein said process further comprises a refrigeration-supply system, within which a refrigeration fluid (31, 32, 34, 38) flows and at least part of the refrigeration fluid from the refrigeration-supply system is introduced (34, 38) into the low-pressure column (5) above the mass transfer section (25), and wherein said refrigeration fluid is removed from the high-pressure column (4), expanded (33) in a work-performing manner in said refrigeration-supply system, and introduced (34) in gaseous form into the low-pressure column (5), or said refrigeration fluid is formed by a cryogenic liquid (38) produced outside the rectification system and said cryogenic liquid is partially or completely introduced into the low-pressure column (5).

2. A process according to claim 1, wherein said refrigeration fluid is removed from the high-pressure column (4), expanded (33) in a work-performing manner in said refrigeration-supply system, and introduced (34) into the low-pressure column (5).

3. A process according to claim 2, wherein said refrigeration fluid (31) is removed from the upper region of the high-pressure column (4).

4. A process according to claim 1, wherein said refrigeration fluid is formed by a cryogenic liquid (38) produced outside the rectification system and said cryogenic liquid is partially or completely introduced into the low-pressure column (5).

5. A process according to claim 1, wherein said refrigerant (13) for the top condenser (17) is removed from the lower region of the low-pressure column (5).

6. A process according to claim 1, wherein all of the oxygen-containing liquid fraction (11) of the high-pressure column (4) is fed (12) into the low-pressure column.

7. A process according to claim 1, wherein said high-purity nitrogen (26) is extracted from the low-pressure column (5) at least partially in gaseous form.

8. A process according to claim 1, wherein said high-purity nitrogen is extracted at least partially in liquid form from the low-pressure column and in evaporated in indirect heat exchange with refrigeration fluid that has been expanded in a work-performing manner.

9. An apparatus for producing nitrogen by low-temperature fractionation of air in a rectification system comprising:

a high-pressure column (4) and a low-pressure column (5);

a feed line (1, 3) for introducing air into the high-pressure column (4);

a line (11) for introducing an oxygen-containing liquid fraction from the high-pressure column (4) into the low-pressure column (5);

a top condenser (17), the liquefaction side of which is connected to a region of the low-pressure column (5) above a mass transfer section (25), said mass transfer section having at least one theoretical or practical plate;

a nitrogen product line (26, 27, 30) for removing high-purity nitrogen, which is connected to the low-pressure column (5) below the mass transfer section (25); and a refrigeration-supply system, which has a refrigeration-fluid line (31, 32, 34; 38) connected to the low-pressure column (5) above the mass transfer section (25), wherein said refrigeration-supply system has an expansion machine (33), the inlet of which is connected to the high-pressure column (4) and the outlet of which is directly connected (34) to low-pressure column (5), or said refrigeration-fluid line is a liquid line (38) for feeding into the refrigeration-supply system a cryogenic liquid produced outside the rectification system.

10. A process according to claim 1, wherein said mass transfer section (25) has 1 to 10 theoretical or practical plates.

11. A process according to claim 1, wherein said high-pressure column (4) operates at a pressure of 9 to 13 bar and said low-pressure column (5) operates at a pressure of 2 to 5 bar.

12. A process according to claim 1, wherein a nitrogen-rich gas fraction is removed from the upper region of said high-pressure column, a part (8) of said nitrogen-rich gas fraction is condensed in a condenser-evaporator (6), and at least part (10) of the resultant liquefied nitrogen-rich fraction is returned to the high-pressure column (4) as reflux.

13. A process according to claim 12, wherein another part of said nitrogen-rich fraction is used as said refrigeration fluid (31) introduced into said low-pressure column.

14. A process according to claim 12, wherein another part (14, 20) of the resultant liquefied nitrogen-rich fraction is introduced into said low-pressure column (5).

15. A process according to claim 13, wherein a further part (14, 20) of the resultant liquefied nitrogen-rich fraction is introduced into said low-pressure column (5).

16. A process according to claim 1, wherein bottom liquid is removed from said low-pressure column, supercooled, and used as said refrigerant (13) for at least partially condensing said gaseous nitrogen in said top condenser (17) by indirect heat exchange.

17. A process according to claim 1, wherein bottom liquid removed from said high-pressure column is supercooled, throttled, and introduced into a lower region of said low-pressure column.

18. A process according to claim 17, wherein another part of bottom liquid removed from said high-pressure column is supercooled, and introduced into said top condenser (17).

19. An apparatus according to claim 9, wherein said mass transfer section (25) has 1 to 10 theoretical or practical plates.

20. A process for producing high-purity nitrogen by low-temperature fractionation of air in a rectification system which comprises a high-pressure column (4) and a low-pressure column (5), said process comprising:

introducing feed air (1, 3) into the high-pressure column (4), removing an oxygen-containing liquid fraction (11) from the high-pressure column (4) and feeding at least a portion of said oxygen-containing liquid fraction into the low-pressure column (5), extracting gaseous nitrogen (18) from the low-pressure column (5) above a mass transfer section (25) which has at least one theoretical or practical plate, and at least partially condensing said gaseous nitrogen in a top condenser (17) by indirect heat exchange with a refrigerant (13), and removing high-purity nitrogen (26, 27, 30) from the low-pressure column (5) below the mass transfer section (25), wherein said process further comprises a refrigeration-supply system, within which a refrigeration fluid (31, 32, 34, 38) flows and at least part of the refrigeration fluid from the refrigeration-supply system is introduced (34, 38) into the low-pressure column (5) above the mass transfer section (25) or into the upper region of the high-pressure column (4), wherein said refrigeration fluid is removed from the high-pressure column (4), expanded (33) in a work-performing manner in said refrigeration-supply system, and introduced (34) into the low-pressure column (5), or said refrigeration fluid is formed by a cryogenic liquid (38) produced outside the rectification system, and wherein said refrigerant (13) for the top condenser (17) is removed from the lower region of the low-pressure column (5).

21. A process for producing high-purity nitrogen by low-temperature fractionation of air in a rectification system which comprises a high-pressure column (4) and a low-pressure column (5), said process comprising:

introducing feed air (1, 3) into the high-pressure column (4), removing an oxygen-containing liquid fraction (11) from the high-pressure column (4) and feeding at least a portion of said oxygen-containing liquid fraction into the low-pressure column (5), extracting gaseous nitrogen (18) from the low-pressure column (5) above a mass transfer section (25) which has at least one theoretical or practical plate, and at least partially condensing said gaseous nitrogen in a top condenser (17) by indirect heat exchange with a refrigerant (13), and removing high-purity nitrogen (26, 27, 30) from the low-pressure column (5) below the mass transfer section (25), wherein said process further comprises a refrigeration-supply system, within which a refrigeration fluid (31, 32, 34, 38) flows and at least part of the refrigeration fluid from the refrigeration-supply system is introduced (34, 38) into the low-pressure column (5) above the mass transfer section (25) or into the upper region of the high-pressure column (4), wherein said refrigeration fluid is removed from the high-pressure column (4), expanded (33) in a work-performing manner in said refrigeration-supply system, and introduced (34) into the low-pressure column (5), or said refrigeration fluid is formed by a cryogenic liquid (38) produced outside the rectification system, and wherein bottom liquid removed from said high-pressure column is supercooled, throttled, and introduced into a lower region of said low-pressure column.

* * * * *